US005408720A

United States Patent [19]

Miles

[11] Patent Number: 5,408,720

[45] Date of Patent: Apr. 25, 1995

[54] MOUNTING ASSEMBLY FOR A SCRAPER BLADE

[75] Inventor: Alan A. Miles, Epsom, United Kingdom

[73] Assignee: Vickerys Limited, London, United Kingdom

[21] Appl. No.: 162,009

[22] PCT Filed: Apr. 6, 1993

[86] PCT No.: PCT/GB93/00718

§ 371 Date: Dec. 9, 1993

§ 102(e) Date: Dec. 9, 1993

[87] PCT Pub. No.: WO93/21380

PCT Pub. Date: Oct. 28, 1993

[30] Foreign Application Priority Data

Apr. 10, 1992 [GB] United Kingdom ..... 9208003

[51] Int. Cl.[6] ..... B21B 45/00

[52] U.S. Cl. ..... 15/256.51; 355/299

[58] Field of Search ..... 15/256.51, 256.5, 236.01, 15/235.4; 355/299; 101/425, 169; 430/125; 100/174, 126; 162/281, 292; 118/261, 70, 413

[56] References Cited

U.S. PATENT DOCUMENTS

| | | | |
|---|---|---|---|
| 3,122,767 | 3/1964 | Carvill | 162/281 |
| 3,163,878 | 1/1965 | Smith et al. . | |
| 3,859,690 | 1/1975 | Brown | 15/256.51 |
| 3,955,531 | 5/1976 | Brown | 118/261 |
| 4,549,933 | 10/1985 | Judd et al. | 15/256.51 |
| 4,906,335 | 3/1990 | Goodnow et al. | 15/256.51 |
| 5,212,226 | 6/1992 | Minford et al. | 156/657 |
| 5,217,477 | 1/1993 | Lager | 606/167 |

FOREIGN PATENT DOCUMENTS

| | | | |
|---|---|---|---|
| 294992 | 12/1988 | European Pat. Off. . | |
| 2856709 | 7/1979 | Germany | 162/281 |
| 9113542 | 7/1992 | Germany | 162/281 |
| 1419614 | 12/1975 | United Kingdom . | |
| 1419874 | 12/1975 | United Kingdom . | |

*Primary Examiner*—David A. Scherbel
*Assistant Examiner*—Tony G. Soohoo

[57] ABSTRACT

A mounting assembly for a scraper blade or cutting blade includes two retaining devices for retaining a first part of the blade therebetween. An operational part of the blade extends from the retaining devices to scrape debris from a roll. One of the retaining devices is a plate made up of a plurality of fibrous layers arranged to provide predetermined strength to the blade in a first direction while allowing flexing of the blade in a second perpendicular direction. The fibrous layers are primarily of woven or laid glass but these layers can also include carbon, ceramic, polyester or aramid fibers. These fibers or monofilament reinforced laminations are encapsulated and bonded in a thermosetting resin to provide desired operational properties.

15 Claims, 4 Drawing Sheets

MOUNTING ASSEMBLY FOR A SCRAPER BLADE

FIELD OF THE INVENTION

The present invention relates to a mounting assembly for a sheet-like member, and is particularly concerned with, but not restricted to, a mounting assembly for a blade.

DESCRIPTION OF THE BACKGROUND ART

One example of such a blade is a scraper blade used in the manufacture of paper. A process for manufacturing paper includes passing a wet fibrous material in sheet form over a series of rolls. During this process the water is allowed to drain off, and the fibrous material is heated to assist the drying process. The paper becomes progressively drier during its passage over the rolls, and at the final stages of the process the finished paper is wound onto a roll ready for delivery.

During the earlier stages of the process there is a tendency for damp fibres to come away from the sheet material and for the fibrous material, and other materials used in the process, such as china clay or titanium, to adhere as debris to the rolls. During the later stages of the process when the fibrous material is dry, protruding fibres are removed from the surface of the fibrous material when this material is in contact with heated rolls. This debris causes irregularities in the otherwise smooth cylindrical surface of the rolls. These irregularities are liable to impede the smooth progress of the sheet material over the roll or to damage the material during its passage over the rolls. This problem also arises in the manufacture of other sheet and film materials, such as for example textiles, in which debris on conveyor rolls or cylinders will affect adversely the product being manufactured.

It has previously been proposed to remove the debris by means of a scraper blade mounted at a suitable angle to the roll surface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
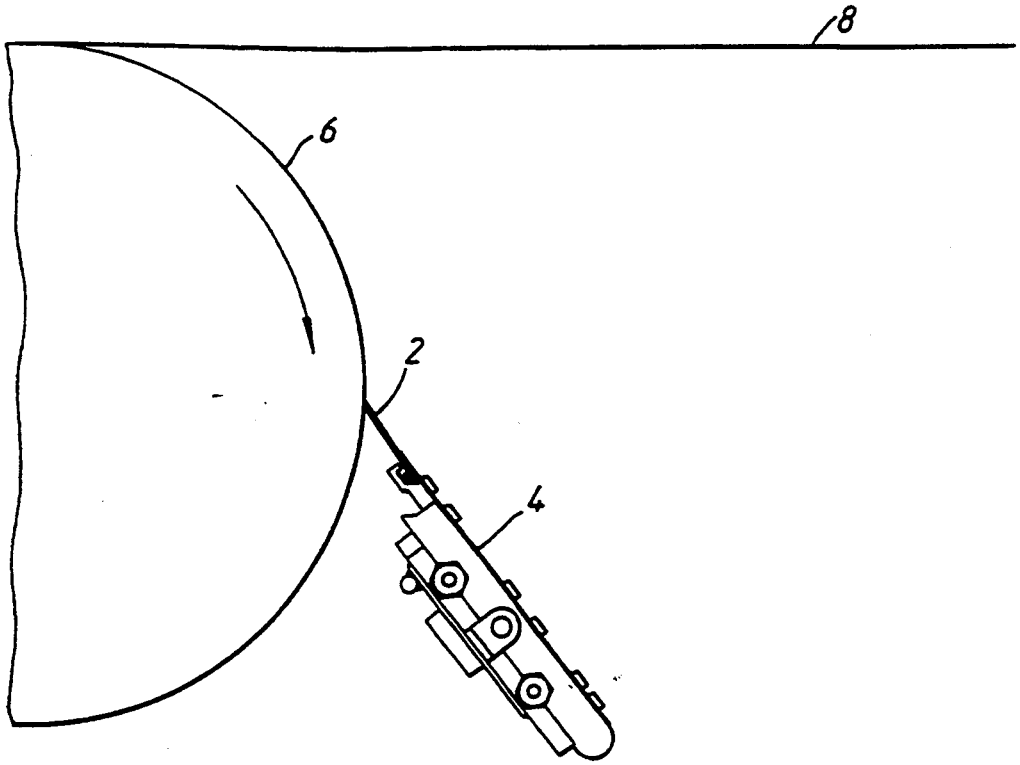
Fig.1. PRIOR ART
FIG. 1 is a diagrammatic side view of a known scraper blade mounting assembly and roll.
Figure 2:
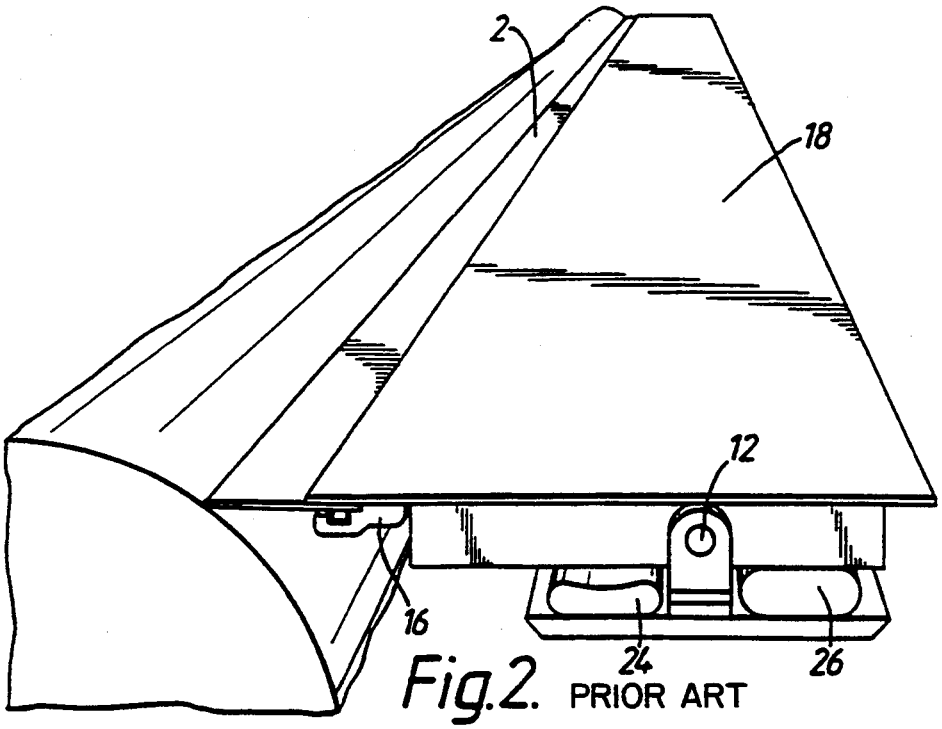
Fig.2. PRIOR ART
FIG. 2 is a perspective view from above of the mounting assembly and roll of FIG. 1.
Figure 3:
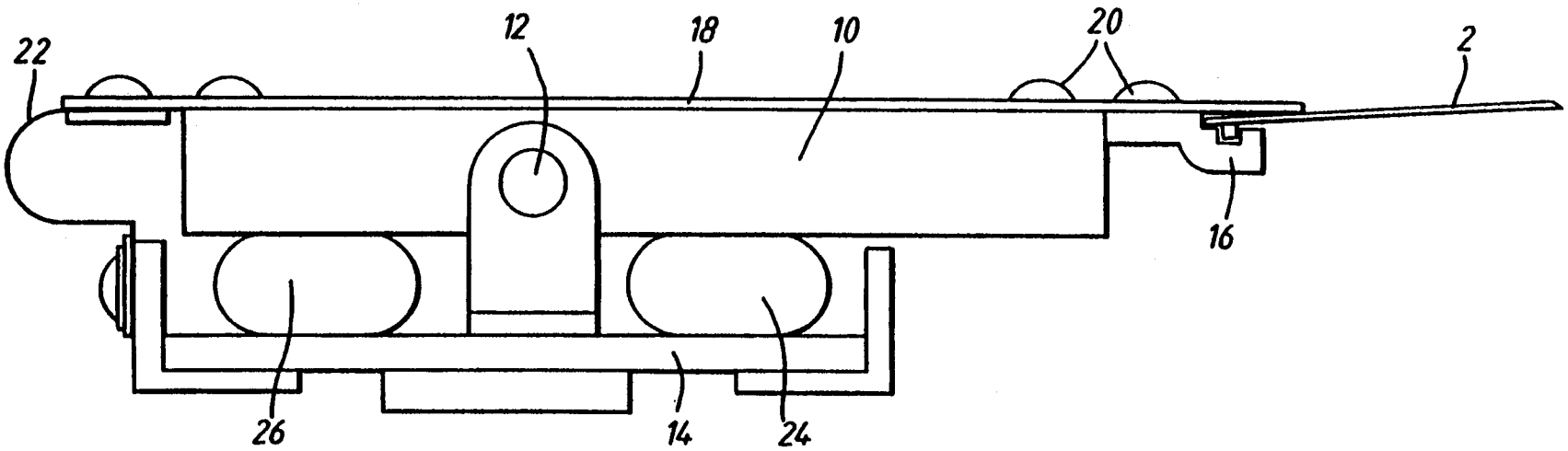
Fig. 3. PRIOR ART
FIG. 3 is a diagrammatic detailed side view of the mounting assembly of FIGS. 1 and 2.

Referring to FIGS. 1 to 3, a scraper blade 2 is mounted in a mounting assembly 4 to contact a roll 6 at a region where it is clear of the sheet material 8 being formed into paper. The roll 6 is rotating clockwise, and the sheet material 8 leaving the roll is travelling to the next stage in the manufacturing process.

The mounting assembly 4 comprises longitudinal, transversely spaced fingers 10 mounted on a pivot 12 secured to a support baseplate 14. The blade 2 is retained against a keep 16 at the front of the assembly 4 by a top plate 18 which is removably mounted on the fingers 10 by screws 20. The above-mentioned components of the mounting assembly are made of stainless steel to reduce the risk of corrosion. A flexible sealing strip 22 at the rear of the mounting assembly prevents the entry of dust or other foreign bodies.

Pneumatic tubes 24, 26 are located in the support baseplate 14 forwardly and rearwardly respectively of the pivot rod 12.

Figure 4:
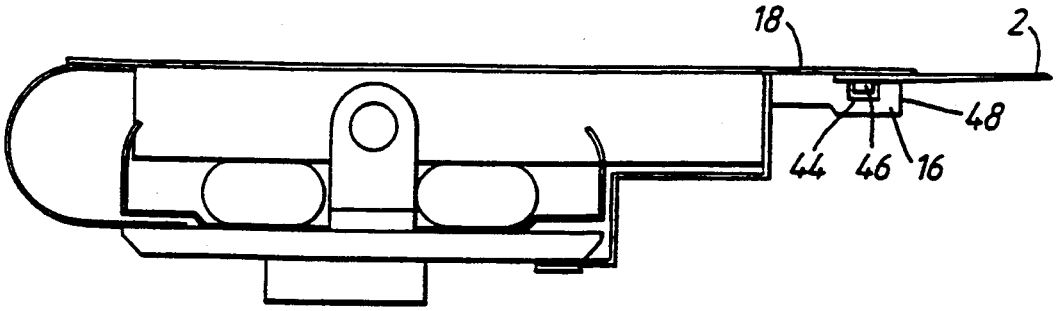
Fig. 4. PRIOR ART
FIG. 4 is a detailed side view of the mounting assembly of FIGS. 1 and 2 showing the mounting of the scraper blade.

Referring particularly to FIG. 4, a U-shaped recess 44 is located in, and extends transversely across, the keep 16. The blade 2 is retained between the keep 16 and the top plate 18 by transversely spaced rivets or tabs 46, which sit in the recess 44. These rivets have a depth greater than the distance between the keep 16 and the top plate 18 thereby preventing the blade 2 from being pulled forwardly out of the mounting assembly. The length of the rivets is less than the width of the recess 44, thereby enabling the blade 2 to slide freely in a longitudinal direction while being retained between the keep 16 and the top plate 18. To remove the blade 2 from the mounting assembly, the blade is slid transversely so that the rivets 46 move along the recess 44 and are withdrawn from one end of the recess 44. A replacement blade is inserted by sliding the rivets into the recess 44 from one end thereof.

In a modified construction, a series of transversely spaced U-shaped openings or castellations are formed in the front wall 48 of the keep 16 to extend from the top of the wall 48. These openings are dimensioned to be slightly larger than the transverse cross-section of the rivets 46, and these openings are positioned so that when the blade 2 is moved transversely a pre-selected distance from its normal central operational position, all the rivets 46 are aligned with corresponding openings. When in this position, the blade 2 can be removed by being pulled forwardly to enable the rivets 46 to pass through their corresponding openings. A replacement blade 2 is inserted into the mounting assembly by aligning the rivets 46 with their corresponding openings, pushing the blade into the mounting assembly so that the rivets 46 are located in the recess 44, and then moving the blade 2 transversely into its central operational position. The blade 2 can be made of metal or a suitable composite material.

In operation, the mounting assembly is located in position adjacent to the roll 6 with the scraper blade 2 in contact with the roll at an appropriate angle to the tangent of the roll 6 at the line of contact.

The air pressure in the tubes 24 and 26 is adjusted so as to rotate the fingers 10 about the pivot rod 12 to retain the blade 2 in contact with the roll 6 at the required pressure. An advantage of this arrangement is that the pressure exerted on the roll surface by the blade 2 can be adjusted without having to change the position of the mounting assembly 4.

It is important that the blade 2 can be mounted flexibly so that the blade 2 will maintain contact with the surface of the roll 6 and will follow any irregularities in the roll surface caused by extreme roll camber or high temperatures, but will be robust enough to remove the full width of material should the web of material break during manufacture. It will be appreciated that it is essential therefore for the top plate 18 to possess a "memory" i.e. after deflection caused by an irregularity in the roll surface it will return to its normal operational position.

As previously mentioned, the known top plate 18 is made of stainless steel to reduce the risk of corrosion. The problem arises that if the carbon content of the stainless steel top plate 18 is reduced to improve the corrosion resistance there is a tendency for the top plate to have no such memory. If this situation exists then the top plate 18 is liable to deform and remain out of contact with the surface of the roll 6 after having been deflected.

It is an aim of the invention to alleviate the above-mentioned problem, and accordingly there is provided a mounting assembly for a sheet-like member, said assembly including two retaining means adapted to retain a first part of said member therebetween with a second part of said member extending from said retaining means, in which one of said retaining means is made up of a plurality of fibrous layers.

The number and orientation of the fibrous layers will depend upon the operational requirements of the sheet-like member, but these parameters are generally chosen to provide sufficient flexural strength in the direction of extension of the sheet-like member from the retaining means, and flexibility in a direction perpendicular to this direction of extension.

Preferably the sheet-like member will be a cutting blade or scraper blade, and in a particular embodiment of the invention the mounting assembly will be part of a paper making plant in which the blade will be used to scrape debris from one or more rolls conveying the sheet-like material during the course of its manufacture. In this embodiment the one retaining means will be in the form of a top plate which is screwed or bolted to transversely spaced fingers of the mounting assembly to retain a scraper blade against a keep forming the other retaining means of the mounting assembly.

The fibrous layers will be primarily of woven or laid glass fibres, but these layers may also include carbon, ceramic, polyester or aramid fibres depending on the specific properties required for the top plate. These woven or laid fibres or monofilament reinforced laminations are encapsulated and bonded in a thermosetting resin formulation thereby obtaining the required properties to make it suitable for use in a paper machine or in a similar environment.

One embodiment of the invention will now be described by way of example with particular reference to FIG. 5 of the accompanying drawings which is an exploded diagrammatic perspective view of the fibrous layers forming one example of a suitable retaining means for the mounting assembly.

Figure 5:
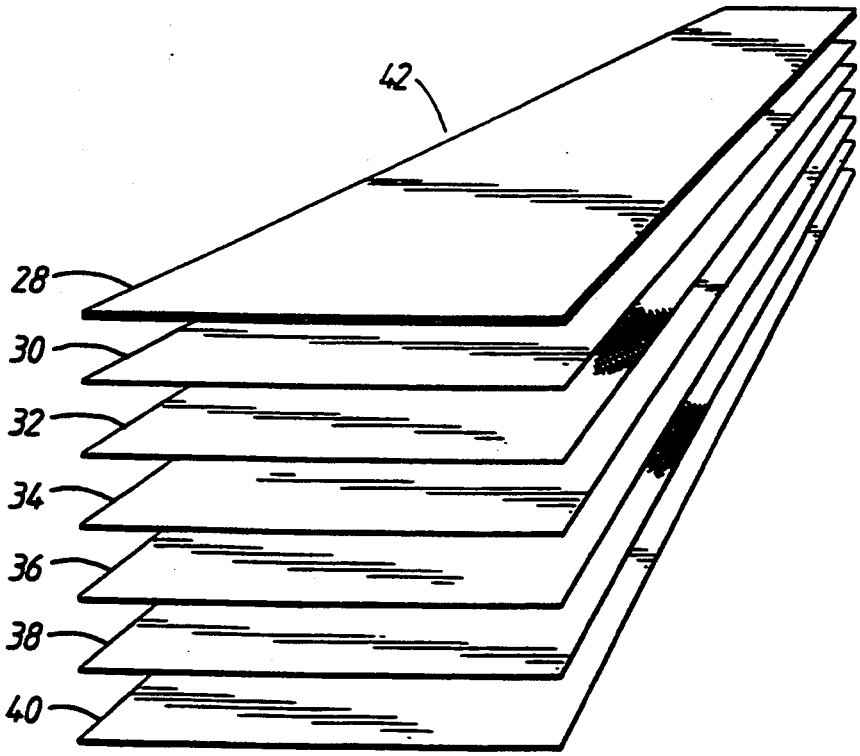
FIG. 5 is an exploded view of a top plate of the invention for the scraper blade mounting assembly.
Figure 6:
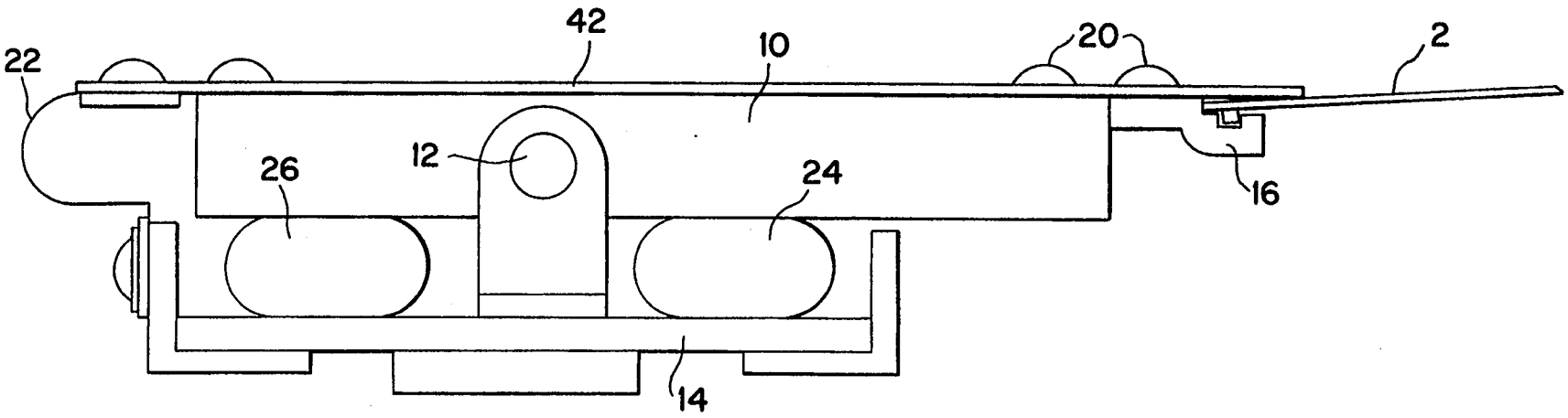
FIG. 6 is a side view of the mounting assembly schematically showing a laminated top plate.

Referring to the drawings, one embodiment of the invention consists of the mounting assembly of FIGS. 1 to 4 in which the top plate 18 of FIG. 3 is replaced by the laminated top plate 42 shown in exploded form in FIG. 5.

Referring particularly to FIG. 5, the laminations 28, to 40 are generally made from woven materials but they may also be laid filaments. In a preferred construction the filaments will be laid at 45° to one another. The individual illustrated laminates are not arranged in any specific order but are illustrated only as typical individual laminations which are arranged randomly. The number of laminations which are used will vary according to the required total thickness of the top plate 42. Although this invention is not restricted to a top plate of any specific thickness, it is envisaged that the top plate thickness could be in the range from a minimum thickness of 1.5 mm to a maximum thickness of 5.0 mm. Similarly, although the invention is not restricted to a top plate 42 of a specific number of layers, it is envisaged that the number of layers could be in the range from 8 to 30 for example. The material of each layer will depend very largely on the strength and flexibility required from the top plate. It is envisaged that the two outer layers will be made from carbon, ceramic or aramid woven or laid fibres, and that the majority of the inner layers will be made of woven or laid glass. This construction does not however preclude the use of fibres other than glass being used in the inner layers 30 to 38 of the top plate 42. This provides the facility to vary the characteristics of the top plate 42 for strength and flexibility in different thicknesses.

In one method of manufacturing the top plate 42, a fibrous multi-layer top plate already impregnated with partially cured thermosetting resin is pressed at high temperature until the resin is cured to provide the completed top plate 42.

The invention being thus described, fit will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A mounting assembly for a sheet-like member, said assembly including at least one finger and two retaining means for retaining a first part of said member therebetween with a second part of said member extending from said two retaining means, one of said retaining means being a plate having a plurality of fibrous layers with a predetermined number and orientation of fibrous layers, said plate cooperating with the other of said retaining means mounted below said plate to retain the sheet-like member against the other retaining means, said finger having a top side and a bottom side, said plate being detachably secured to an outermost portion of said top side of said at least one finger.

2. The assembly as claimed in claim 1, in which the number and orientation of the fibrous layers provides a predetermined flexural strength in a first direction and a predetermined flexibility in a second direction, the first direction being perpendicular to the second direction and the first direction extending longitudinally of the sheet-like member.

3. The mounting assembly as claimed in claim 1, in which the sheet-like member is a cutting blade or a scraper blade.

4. The mounting assembly as claimed in claim 3, in which the other retaining means of the mounting assembly is a keep.

5. The mounting assembly as claimed in claim 1, in which the fibrous layers are primarily of woven or laid glass fibers.

6. The mounting assembly as claimed in claim 5, in which the layers also include carbon, ceramic, polyester or aramid fibers.

7. The mounting assembly as claimed in claim 5, in which the woven or laid fibers are encapsulated and bonded in a thermosetting resin formulation.

8. The mounting assembly as claimed in claim 5, in which the fibrous layer includes monofilament reinforce laminations encapsulated and bonded in a thermosetting resin formulation.

9. The mounting assembly as claimed in claim 1, in which plate thickness is in a range from 1.5 mm to 5.0 mm.

10. The mounting assembly as claimed in claim 1, in which a number of fibrous layers in the plate is in a range from 8 to 30.

11. The mounting assembly as claimed in claim 1, in which the two outer layers are made from carbon woven fibers, ceramic woven fibers, aramid woven fibers, carbon laid fibers, ceramic laid fibers or aramid laid fibers.

12. The mounting assembly as claimed in claim 11, in which a majority of the inner layers are made of woven or laid glass.

13. The mounting assembly as claimed in claim 1, wherein the plate is flat.

14. The mounting assembly as claimed in claim 1, further including a baseplate, a forward tube and a rearward tube, the at least one finger being pivotally mounted to the baseplate about a pivot, the forward tube being on one side of the pivot and the rearward tube being on another side of the pivot, the forward and rearward tubes being inflatable and deflatable to move the at least one finger about the pivot.

15. The mounting assembly as claimed in claim 1, wherein the other retaining means has a groove defined therein, the mounting assembly further comprising rivets which are insertable into the groove defined in the other retaining means to hold the sheet-like member between the plate and the other retaining means.

* * * * *